US011525347B2

(12) United States Patent
Alharith

(10) Patent No.: US 11,525,347 B2
(45) Date of Patent: Dec. 13, 2022

(54) METHOD AND SYSTEM FOR DOWNHOLE STEAM GENERATION USING LASER ENERGY

(71) Applicant: SAUDI ARABIAN OIL COMPANY, Dhahran (SA)

(72) Inventor: Abdullah M. Alharith, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/242,838

(22) Filed: Apr. 28, 2021

(65) Prior Publication Data

US 2022/0349288 A1 Nov. 3, 2022

(51) Int. Cl.
*E21B 43/24* (2006.01)
*F22B 3/00* (2006.01)

(52) U.S. Cl.
CPC ..... *E21B 43/2406* (2013.01); *F22B 3/00* (2013.01)

(58) Field of Classification Search
None
See application file for complete search history.

(56) References Cited

U.S. PATENT DOCUMENTS

| | | | |
|---|---|---|---|
| 4,228,856 | A | 10/1980 | Reale |
| 4,658,115 | A | 4/1987 | Heath |
| 5,623,576 | A | 4/1997 | Deans |
| 7,040,390 | B2 | 5/2006 | Tubel et al. |
| 7,487,834 | B2 | 2/2009 | Reed et al. |
| 8,333,239 | B2 | 12/2012 | Schneider et al. |
| 8,528,643 | B2 | 9/2013 | Schultz et al. |
| 8,733,437 | B2 | 5/2014 | Ware et al. |
| 9,057,232 | B2 | 6/2015 | Cioanta et al. |
| 9,347,271 | B2 | 5/2016 | Zediker et al. |
| 9,534,447 | B2 | 1/2017 | Zediker et al. |
| 9,939,421 | B2 | 4/2018 | Batarseh et al. |
| 2004/0206505 | A1 | 10/2004 | Batarseh |
| 2008/0236817 | A1 | 10/2008 | Tillman |
| 2013/0008659 | A1 | 1/2013 | Schultz et al. |
| 2014/0305877 | A1 | 10/2014 | Cioanta et al. |
| 2016/0069857 | A1 | 3/2016 | Batarseh et al. |
| 2020/0392824 | A1 | 12/2020 | Batarseh et al. |

FOREIGN PATENT DOCUMENTS

| | | | |
|---|---|---|---|
| AU | 2015203686 | A1 | 7/2015 |
| WO | 2017/163265 | A1 | 9/2017 |

OTHER PUBLICATIONS

Batarseh, Sameeh I., et al., "High Power Laser Technology in Downhole Applications, Reshaping the Industry", Society of Petroleum Engineers, pp. 1-15, Nov. 13-16, 2017 (15 pages).

International Search Report and Written Opinion of the International Searching Authority issued in corresponding International Application No. PCT/US2022/026787, dated Jun. 27, 2022 (14 pages).

*Primary Examiner* — Charles R Nold
(74) *Attorney, Agent, or Firm* — Osha Bergman Watanabe & Burton LLP

(57) ABSTRACT

An apparatus may include an inlet and an enclosure includes a container that is coupled to the inlet. The container may receive water from the inlet. The apparatus may further include various check valves coupled to the container. The apparatus may further include a laser head coupled to the container. The laser head may receive a laser signal that converts the water inside the container into steam. The check valves may release the steam outside the enclosure.

10 Claims, 5 Drawing Sheets

METHOD AND SYSTEM FOR DOWNHOLE STEAM GENERATION USING LASER ENERGY

BACKGROUND

Various unconventional reservoirs may have high viscosity oil that provides complex and challenging situations for drilling and recovery. One technique for increasing the extraction of this high viscosity oil from an unconventional reservoir is steam injection. In particular, steam injection may enhance oil recovery by using thermal energy to stimulate the oil reservoir. For example, a steam plant may be constructed at a well site, and the steam plant may subsequently inject steam into a well head for this stimulation operation.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a system that includes a laser source and a steam generating apparatus coupled to the laser source and disposed in a wellbore. The steam generating apparatus includes a container and various check valves. The steam generating apparatus converts water inside the container into steam using a laser signal transmitted to the container from the laser source. The steam is released into the wellbore using the check valves.

In general, in one aspect, embodiments relate to an apparatus that includes an inlet and an enclosure that includes a container that is coupled to the inlet. The container receives water from the inlet. The apparatus further includes various check valves coupled to the container. The apparatus further includes a laser head coupled to the container. The laser head receives a laser signal that converts the water inside the container into steam. The check valves release the steam outside the enclosure.

In general, in one aspect, embodiments relate to a method that includes obtaining, using a control system, stimulation data for a well stimulation operation based on well data regarding a geological region of interest. The method further includes determining, using the control system, a steam operation for the well stimulation operation based on the stimulation data. The method further includes disposing, using the control system, a steam generating apparatus at a predetermined location in a wellbore within the geological region of interest. The method further includes transmitting, using the control system, a laser signal to the steam generating apparatus based on the steam operation.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include systems and methods for stimulating a reservoir using a steam generating apparatus. In some embodiments, for example, steam may be generated in situ within a wellbore to increase temperature of one or more target zones in a geological region. In particular, a target zone may include a region of highly viscous hydrocarbons, where treating the target zone with heat may reduce the viscosity in order to increase hydrocarbon production. As such, a steam generating apparatus may be a device that is lowered in a wellbore, e.g., using a cable conveyance system, that subsequently produces steam using laser signals to heat water in a container within the steam generating apparatus. Likewise, the laser signals may be obtained from a well's surface using optical fiber cables that are connected to a laser source. From a continuous water supply, the steam generating apparatus may provide continuous steam to the target zones in the wellbore to increase fluid flow and production.

Furthermore, some embodiments may reduce wellbore heat loss from steam traveling from the well surface deep into the reservoir by using a steam generating apparatus proximate a target zone. This heating problem may especially worsen as the depth of the reservoir increases. Similarly, steam quality available for injection may also decrease with increasing wellbore length. Accordingly, some embodiments increase energy efficiency of a well stimulation process by disposing one or more steam generating apparatuses near one or more target zones.

Figure 1:
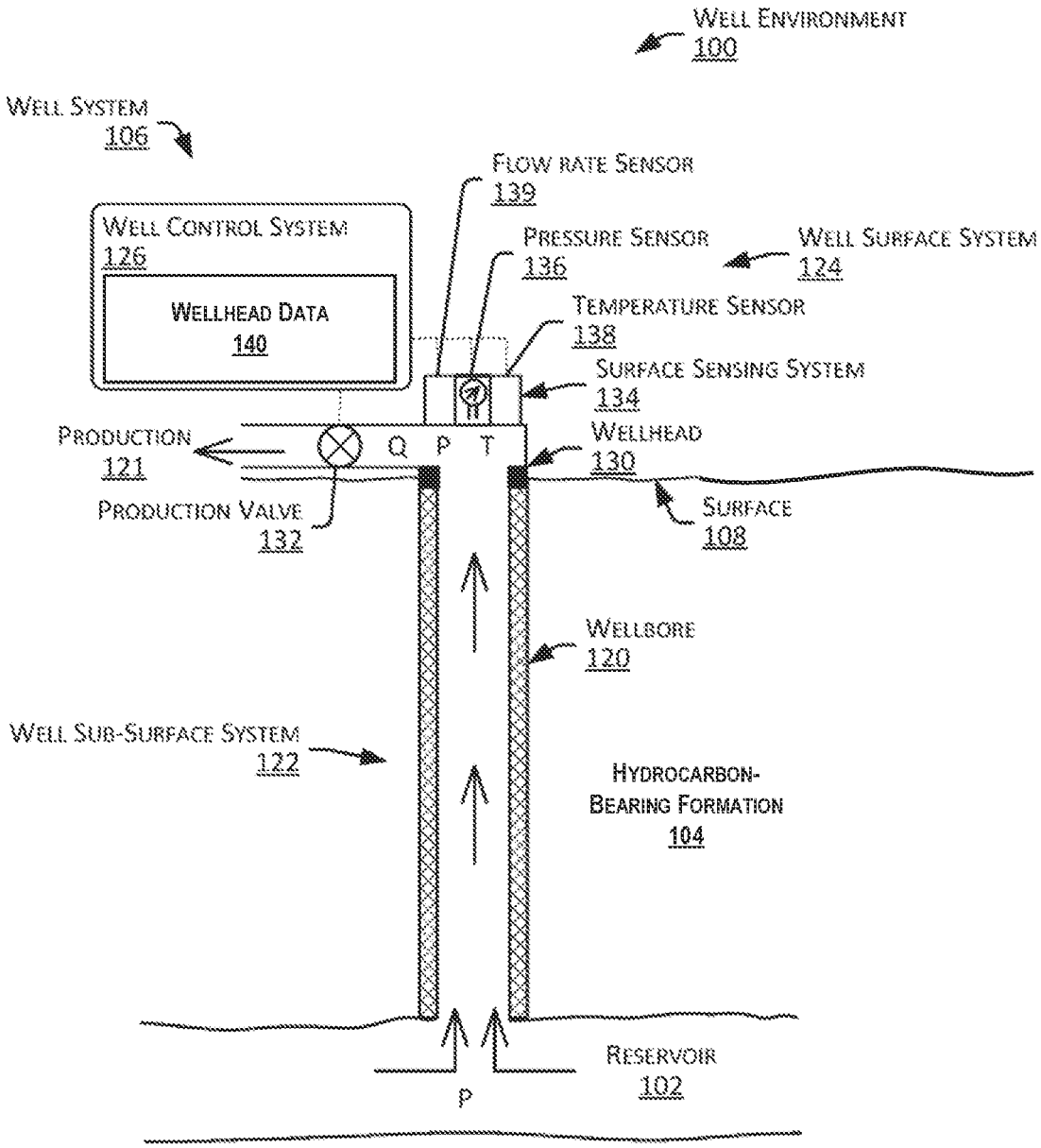
FIGS. 1, 2, and 3 show systems in accordance with one or more embodiments.

Turning to FIG. 1, FIG. 1 shows a schematic diagram in accordance with one or more embodiments. As shown in FIG. 1, FIG. 1 illustrates a well environment (100) that includes a hydrocarbon reservoir ("reservoir") (102) located in a subsurface hydrocarbon-bearing formation (104) and a well system (106). The hydrocarbon-bearing formation (104) may include a porous or fractured rock formation that resides underground, beneath the earth's surface ("surface") (108). In the case of the well system (106) being a hydrocarbon well, the reservoir (102) may include a portion of the hydrocarbon-bearing formation (104). The hydrocarbon-bearing formation (104) and the reservoir (102) may include different layers of rock having varying characteristics, such as varying degrees of permeability, porosity, and resistivity. In the case of the well system (106) being operated as a production well, the well system (106) may facilitate the extraction of hydrocarbons (or "production") from the reservoir (102).

In some embodiments, the well system (106) includes a wellbore (120), a well sub-surface system (122), a well surface system (124), and a well control system (126). The control system (126) may control various operations of the well system (106), such as well production operations, well completion operations, well maintenance operations, and reservoir monitoring, assessment and development operations. In some embodiments, the control system (126) includes a computer system that is the same as or similar to that of computer system (502) described below in FIG. 5 and the accompanying description.

The wellbore (120) may include a bored hole that extends from the surface (108) into a target zone of the hydrocarbon-bearing formation (104), such as the reservoir (102). An upper end of the wellbore (120), terminating at or near the surface (108), may be referred to as the "up-hole" end of the wellbore (120), and a lower end of the wellbore, terminating in the hydrocarbon-bearing formation (104), may be referred to as the "downhole" end of the wellbore (120). The wellbore (120) may facilitate the circulation of drilling fluids during drilling operations, the flow of hydrocarbon production ("production") (121) (e.g., oil and gas) from the reservoir (102) to the surface (108) during production operations, the injection of substances (e.g., water) into the hydrocarbon-bearing formation (104) or the reservoir (102) during injection operations, or the communication of monitoring devices (e.g., logging tools) into the hydrocarbon-bearing formation (104) or the reservoir (102) during monitoring operations (e.g., during in situ logging operations).

In some embodiments, during operation of the well system (106), the control system (126) collects and records wellhead data (140) for the well system (106). The wellhead data (140) may include, for example, a record of measurements of wellhead pressure (P) (e.g., including flowing wellhead pressure (FWHP)), wellhead temperature (T) (e.g., including flowing wellhead temperature), wellhead production rate (Q) over some or all of the life of the well (106), and water cut data. In some embodiments, the measurements are recorded in real-time, and are available for review or use within seconds, minutes or hours of the condition being sensed (e.g., the measurements are available within 1 hour of the condition being sensed). In such an embodiment, the wellhead data (140) may be referred to as "real-time" wellhead data (140). Real-time wellhead data (140) may enable an operator of the well (106) to assess a relatively current state of the well system (106), and make real-time decisions regarding development of the well system (106) and the reservoir (102), such as on-demand adjustments in regulation of production flow from the well.

With respect to water cut data, the well system (106) may include one or more water cut sensors. For example, a water cut sensor may be hardware and/or software with functionality for determining the water content in oil, also referred to as "water cut." Measurements from a water cut sensor may be referred to as water cut data and may describe the ratio of water produced from the wellbore (120) compared to the total volume of liquids produced from the wellbore (120). In some embodiments, a water-to-gas ratio (WGR) is determined using a multiphase flow meter. For example, a multiphase flow meter may use magnetic resonance information to determine the number of hydrogen atoms in a particular fluid flow. Since oil, gas and water all contain hydrogen atoms, a multiphase flow may be measured using magnetic resonance. In particular, a fluid may be magnetized and subsequently excited by radio frequency pulses. The hydrogen atoms may respond to the pulses and emit echoes that are subsequently recorded and analyzed by the multiphase flow meter.

In some embodiments, the well surface system (124) includes a wellhead (130). The wellhead (130) may include a rigid structure installed at the "up-hole" end of the wellbore (120), at or near where the wellbore (120) terminates at the Earth's surface (108). The wellhead (130) may include structures for supporting (or "hanging") casing and production tubing extending into the wellbore (120). Production (121) may flow through the wellhead (130), after exiting the wellbore (120) and the well sub-surface system (122), including, for example, the casing and the production tubing. In some embodiments, the well surface system (124) includes flow regulating devices that are operable to control the flow of substances into and out of the wellbore (120). For example, the well surface system (124) may include one or more production valves (132) that are operable to control the flow of production (134). For example, a production valve (132) may be fully opened to enable unrestricted flow of production (121) from the wellbore (120), the production valve (132) may be partially opened to partially restrict (or "throttle") the flow of production (121) from the wellbore (120), and production valve (132) may be fully closed to fully restrict (or "block") the flow of production (121) from the wellbore (120), and through the well surface system (124).

Keeping with FIG. 1, in some embodiments, the well surface system (124) includes a surface sensing system (134). The surface sensing system (134) may include sensors for sensing characteristics of substances, including production (121), passing through or otherwise located in the well surface system (124). The characteristics may include, for example, pressure, temperature and flow rate of production (121) flowing through the wellhead (130), or other conduits of the well surface system (124), after exiting the wellbore (120).

In some embodiments, the surface sensing system (134) includes a surface pressure sensor (136) operable to sense the pressure of production (151) flowing through the well surface system (124), after it exits the wellbore (120). The surface pressure sensor (136) may include, for example, a wellhead pressure sensor that senses a pressure of production (121) flowing through or otherwise located in the wellhead (130). In some embodiments, the surface sensing system (134) includes a surface temperature sensor (138) operable to sense the temperature of production (151) flowing through the well surface system (124), after it exits the wellbore (120). The surface temperature sensor (138) may include, for example, a wellhead temperature sensor that senses a temperature of production (121) flowing through or otherwise located in the wellhead (130), referred to as "wellhead temperature" (T). In some embodiments, the surface sensing system (134) includes a flow rate sensor (139) operable to sense the flow rate of production (151) flowing through the well surface system (124), after it exits the wellbore (120). The flow rate sensor (139) may include hardware that senses a flow rate of production (121) (Q) passing through the wellhead (130).

Figure 2:
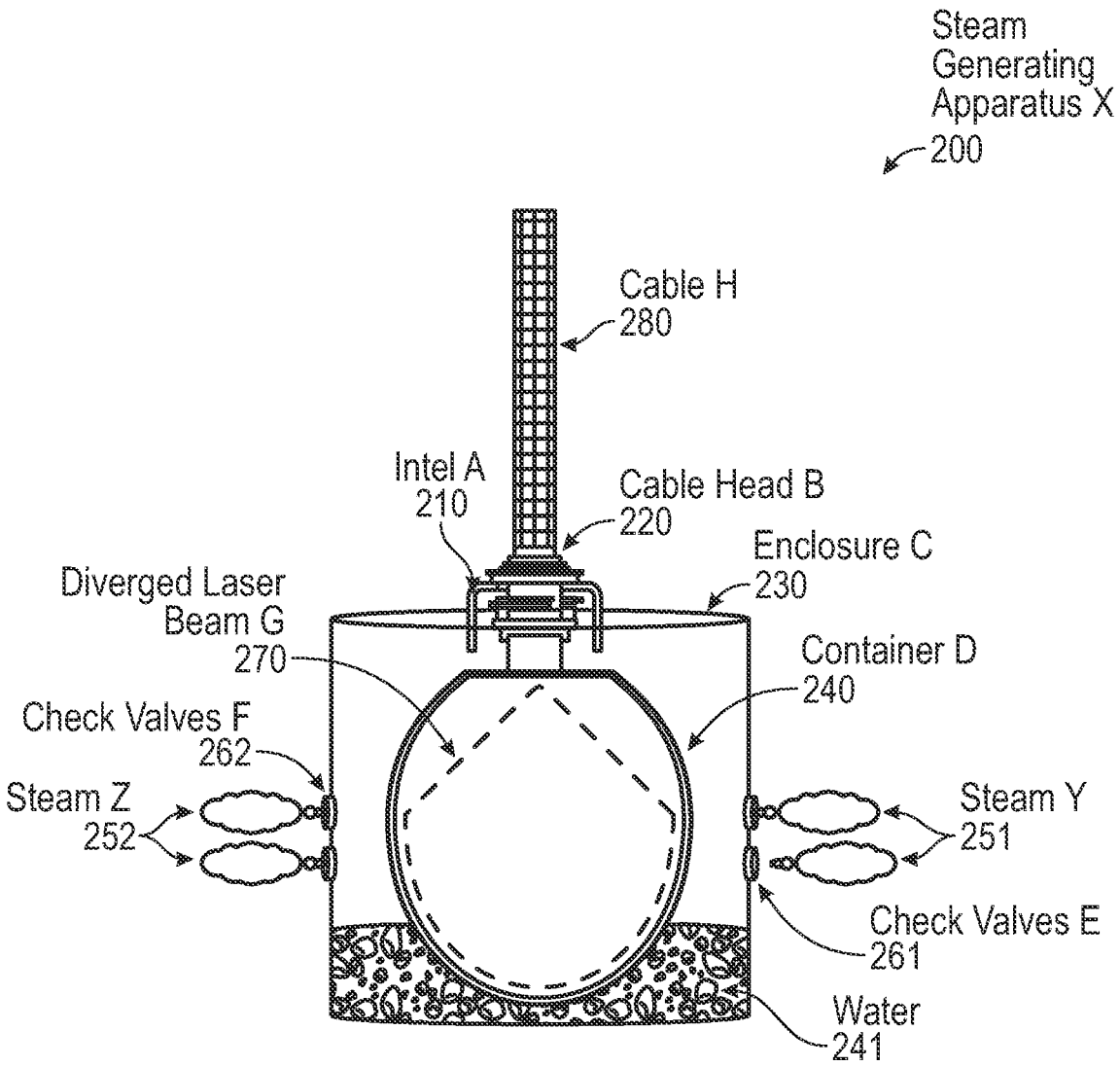

Turning to FIG. 2, FIG. 2 shows a schematic diagram in accordance with one or more embodiments. As illustrated in FIG. 2, a steam generating apparatus (e.g., steam generating apparatus X (200)) may include an enclosure (e.g., enclosure C (230)) and a container (e.g., container D (240)) for holding water (e.g., water (241)). In particular, the steam generating apparatus may receive a laser signal that produces a diverged laser beam (e.g., diverged laser beam G (270)) inside a container to produce steam (e.g., steam Y (251), steam Z (252)). For example, the container may be a spherical container made of steel or any other suitable shape or material, where the container is disposed inside a closed chamber, such as enclosure C (230).

In some embodiments, a steam generating apparatus obtains a laser signal from a laser head coupled to a container inside the steam generating apparatus. For example, a laser head may include a hardware assembly, include such focusing optical components as lenses, optical waveguides, and optical splitters that direct a laser beam toward a predetermined area. This predetermined area may be a location of water inside a container. Moreover, a laser head may not include a laser source, but may instead receive a laser signal from an external laser source. In some embodiments, for example, a laser signal enters a laser head via an optical fiber cable coupled to a laser source on a well surface. Once a laser signal enters a steam generating apparatus, a laser head may spread the laser signal as a laser beam to increase the temperature of the container. By increasing the container's temperature, thermal conduction may be used to boil the water inside the steam generating apparatus and produce steam.

In some embodiments, a steam generating apparatus includes one or more check valves (e.g., check valves E (261), check valves F (262)) with functionality for emitting steam e.g., to heat oil or other hydrocarbon materials proximate a wellbore. In particular, a check valve may be a non-return valve that allows flow in a single direction only. Once steam accumulates inside the steam generating apparatus, pressure may also increase causing steam to automatically surge through the check valves to a wellbore. For example, one or more fluid lines may couple the water inside a container to the check valves. As such, check valves may operate entirely by reaction to pressure in the container and therefore require no external actuation. Likewise, check valves may also prevent well fluids and other materials within a wellbore and/or an adjacent reservoir zone from entering into the steam generating apparatus, such as into container. Multiples types of check valves are contemplated, such as lift check valves, disc check valves, wafer check valves, swing check valves, and other valve types.

In some embodiments, a steam generating apparatus includes one or more inlets (e.g., inlet A (210)) to receive water from an external water source. For example, a water inlet may be attached on top of a steam generating apparatus to supply water for steam generation. Likewise, an outlet in a container may be coupled to the inlet by one or more fluid paths. A water supply may be located on a well surface, where water may be pumped to a steam generating apparatus disposed downhole in a wellbore. For example, water may reach an inlet through a cable shared with an optical fiber for the laser signal. In some embodiments, a separate cable is used to supply water to the steam generating apparatus. While the "steam" generating apparatus is described in reference to water, other embodiments are also contemplated for generating any type of heated liquid, gas, or liquid-gas mixture. As such, other liquid supplies may be used in addition to or in place of water.

In some embodiments, a steam generating apparatus includes a cable head (e.g., cable head B (220)) that is coupled to a cable (e.g., cable H (280)). In some embodiments, the cable head is a laser head, where the cable corresponds to an optical fiber cable. In some embodiments, the cable includes multiple cable types, such as data signal cables, optical fiber cables, support materials, fluid lines for supplying water or other liquids, etc. For example, the cable H (280) may have multiple cables embedded inside it, such as a fiber optic cable line for laser signals and another cable line for water. Likewise, the cable coupled to the cable head may be used to raise and lower the steam generating apparatus inside the wellbore (e.g., by coupling to a cable conveyance system).

Figure 3:
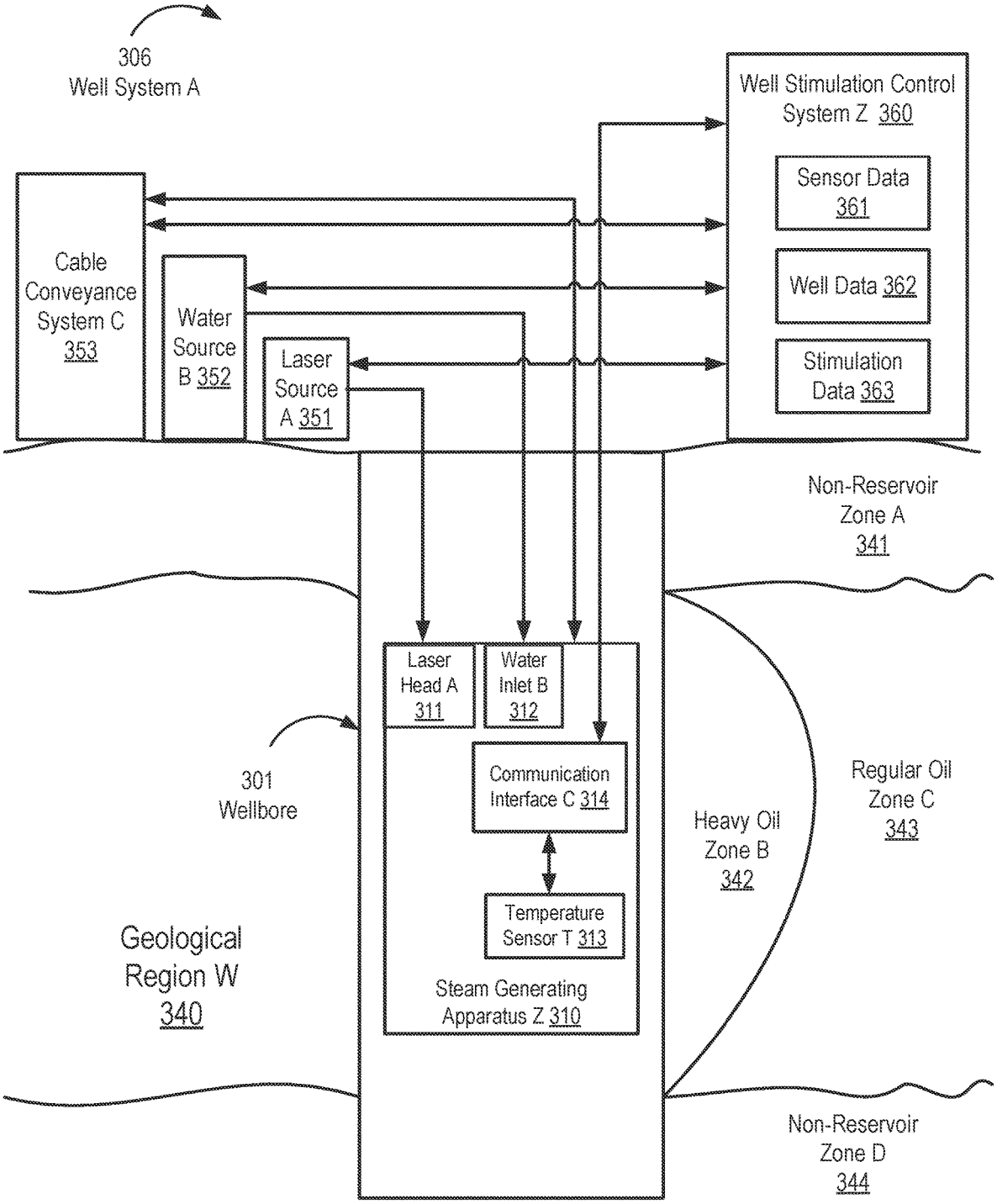

Turning to FIG. 3, FIG. 3 shows a schematic diagram in accordance with one or more embodiments. As illustrated in FIG. 3, a well system (e.g., well system A (306)) may include one or more steam generating apparatuses (e.g., steam generating apparatus Z (310)) coupled to a laser source (e.g., laser source A (351)), a water source (e.g., water source B (352)), and a cable conveyance system (e.g., cable conveyance C (353)). In some embodiments, for example, steam generating apparatuses are used to inject steam downhole into a geological region (e.g., geological region W (340)) to mobilize heavy and viscous hydrocarbons to increase production. More specifically, a geological region may include multiple zones, such as non-reservoir zones (e.g., non-reservoir zone A (341), non-reservoir zone D (344)), production zones (e.g., regular oil zone C (343)), and/or unconventional hydrocarbon zones (e.g., heavy oil zone B (342)). In a well stimulation operation, a steam generating apparatus may produce steam in situ and proximate a target zone (e.g., heavy oil zone B (342)) in a geological region rather than generating steam on a well's surface for transporting through an entire wellbore (e.g., wellbore (301)). Thus, in FIG. 3, steam may surge into the wellbore at the heavy oil zone B (342) from the steam generating apparatus Z (310). As such, continuous steam generation may be produced in a stimulation operation using one or more steam generating apparatuses.

Furthermore, many viscous hydrocarbon reservoirs exist throughout the world, where these reservoirs may include a very viscous hydrocarbon, often called "bitumen," "tar," "heavy oil," or "ultra heavy oil," (collectively referred to herein as "heavy oil"). Typically, heavy oil may have viscosities in the range from 100 to over 1,000,000 centipoise. High viscosity levels may make recovery of this heavy oil very difficult. Accordingly, a steam generating apparatus may be employed in various types of stimulation operations to recover the viscous hydrocarbons therein. For example, steam may be used to heat the heavy oil in situ to lower the viscosity and increase hydrocarbon production. Examples of such stimulation operations include cyclic steam stimulation (CSS), steam drive or steam flooding, and steam-assisted gravity drainage (SAGD).

A CSS operation (also called a "huff-n-puff" method) may include various stages to enhance oil production. In one stage, the CSS operation may use a steam generating apparatus to produce high-pressure steam through a target zone for a particular period of time to reduce oil viscosity. In the next stage, a soaking period may be used to diffuse the steam through a reservoir. In the final stage, oil may be produced from the same well following the stimulation operation. With respect to multilayer reservoirs, a CSS operation may begin at a bottom layer of the reservoir and the CSS operation may move through subsequent layers to a final top layer of the reservoir.

A steam flooding operation may include generating steam in multiple injection wells to increase production in production wells. When steam enters one or more target zones of a reservoir, the steam may heat up the heavy oil to reduce its viscosity. Likewise, the heat may also distill various light components of the respective crude oil. As such, the steam flooding operation may produce an artificial drive that sweeps oil toward one or more production wells.

A SAGD operation may include drilling two or more horizontal wellbores into a reservoir, such that at least one of horizontal wellbores is a few meters above another wellbore. As such, the SAGD operation may include generating high pressure steam continuously in the upper wellbore to heat the heavy oil and reduce viscosity. The heated oil may then drain into the lower wellbore, where the oil is pumped out.

Keeping with FIG. 3, a laser source may include hardware and/or software with functionality for generating one or more laser signals for transmission to a steam generating apparatus (e.g., steam generating apparatus Z (310)). For example, a laser source may be a continuous wave (CW) fiber laser that couples to an optical fiber cable. The laser source may transmit the laser signal over the optical fiber cable to a laser head (e.g., laser head A (311)) on the steam generating apparatus. As such, the laser source may include various optical components, such as gain modules, optical amplifiers, interferometer arms, optical waveguides, and laser diodes. Likewise, the laser source may generate a laser signal that travels over a cable through a wellbore to a particular reservoir zone in order to heat water into steam, e.g., a 1 kilowatt laser signal may be sufficient for creating steam in some embodiments.

With respect to water sources, a water source may include one or more supply tanks disposed on a well surface that are coupled to a steam generating apparatus. For example, a water source may include various fluid lines, pumps, pipes, valves, and other water equipment coupled to a water supply. A water source may be coupled to an inlet (e.g., water inlet B (312)) on a steam generating apparatus in order to provide water for generating steam for a stimulation operation.

With respect to cable conveyance system, a cable conveyance system may include hardware for moving a steam generating apparatus to a predetermined location within a wellbore, e.g., proximate a heavy oil zone or a steam flooding spot. In particular, a conveyance system may include a riser assembly, a reel assembly, one or more cable lines, and other mechanical components for transporting the steam generating apparatus through vertical and/or deviated wells. For example, a cable conveyance system may be coupled to a wellhead and supported by a crane. Likewise, the cable conveyance system may adapted with a derrick in a free-point rig-up arrangement. In some embodiments, the conveyor cable system is similar to a wireline conveyor system for one or more well logging tools.

In some embodiments, a steam generating apparatus is coupled to a well stimulation control system (e.g., well stimulation control system Z (360)). A well stimulation control system may be coupled to a laser source (e.g., laser source A (351)), a water supply (e.g., water supply B (352)), and/or a cable conveyance system (e.g., cable conveyance system C (353)) in order to control one or more steam operations using various commands and/or control signals. For example, a well stimulation control system may include hardware and/or software with functionality for implementing a predetermined stimulation operation by managing steam operations of one or more steam generating apparatuses. For example, a steam operation and/or well stimulation operation may be managed using sensor data (e.g., sensor data (361)), well data (e.g., well data (362)), and/or stimulation data (e.g., stimulation data (363)).

Furthermore, a well stimulation control system may include one or more programmable logic controllers (PLCs) that include hardware and/or software with functionality to control one or more processes performed by a well system (e.g., well system A (306)) for the stimulation operation. Specifically, a programmable logic controller may control valve states, fluid levels, pipe pressures, warning alarms, and/or pressure releases throughout a steam generating apparatus and related equipment. In particular, a programmable logic controller may be a ruggedized computer system with functionality to withstand vibrations, extreme temperatures, wet conditions, and/or dusty conditions, for example, around a drilling rig or a well site. Without loss of generality, the term "control system" may refer to a stimulation operation control system that is used to operate and control the equipment, a stimulation data acquisition and monitoring system that is used to acquire well data and/or stimulation data process to monitor a stimulation operation, or a stimulation interpretation software system that is used to analyze and understand well events and stimulation progress. In some embodiments, the well stimulation control system Z (360) may include a computer system that is similar to the computer system (502) and/or the well control system (126) described with respect to FIGS. 1 and 5 and the accompanying description, respectively.

In some embodiments, a steam generating apparatus includes one or more sensors (e.g., temperature sensor T (313)) for managing a steam operation in a wellbore. For example, a temperature sensor may be used to monitor water temperature in a container to determine progress of steam generation and whether the steam operation is complete. For example, a steam generating apparatus may include a processor and memory to automatically manage the steam operation using temperature sensor data. In some embodiments, a steam generating apparatus transmits sensor data (e.g., sensor data (361)) using a communication interface (e.g., communication interface C (314)) to a well stimulation control system, where the control system automatically manages one or more states on the steam generating apparatus. While a steam generating apparatus may include various "smart" functionality, embodiments are contemplated where the steam generating apparatus operates independent of a control system and/or without an onboard computer.

While FIGS. 1, 2, and 3 shows various configurations of hardware components and/or software components, other configurations may be used without departing from the scope of the disclosure. For example, various components in FIGS. 1, 2, and 3 may be combined to create a single component. As another example, the functionality performed by a single component may be performed by two or more components.

Figure 4:
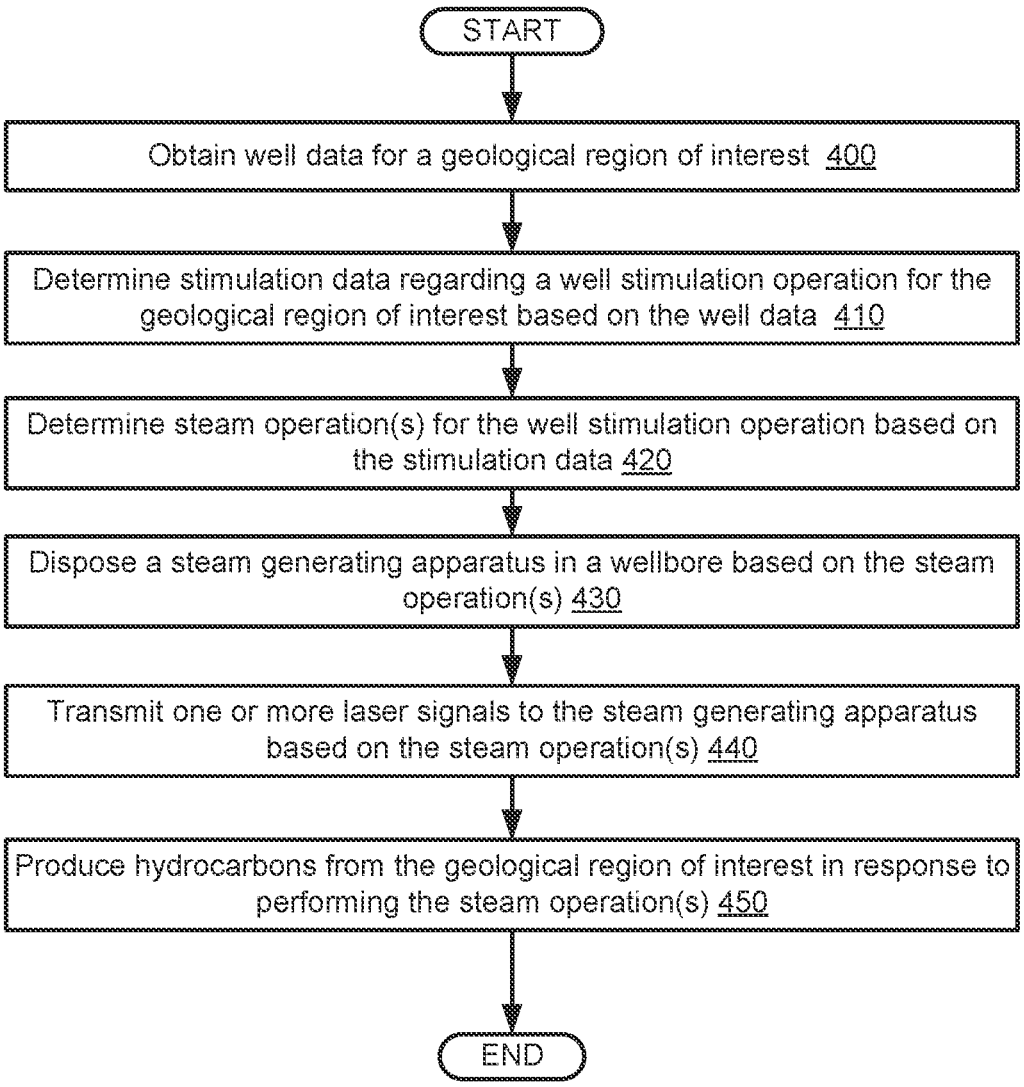
FIG. 4 shows a flowchart in accordance with one or more embodiments.

Turning to FIG. 4, FIG. 4 shows a flowchart in accordance with one or more embodiments. Specifically, FIG. 4 describes a general method for performing a stimulation operation with one or more steam generating apparatuses. One or more blocks in FIG. 4 may be performed by one or more components (e.g., well stimulation control system Z (360)) as described in FIGS. 1, 2, and 3. While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 400, well data are obtained for a geological region of interest in accordance with one or more embodiments. For example, well data may correspond to wellhead data described above in FIG. 1 as well as various well design parameters, e.g., a type of wellbore, such as a vertical or horizontal well, various types of completion operations, whether the well is a production well or an injection well, etc. Well data may also include historical production data or historical injection data, such as flow rate data, surface pressure data, etc., or simulated well data from one or more previous reservoir simulations. A geological region of interest may be a portion of a geological area or volume that includes one or more wells or formations of interest desired or selected for further analysis, e.g., for enhancing future hydrocarbon production or reservoir development purposes for a respective reservoir. For example, the geological region of interest may be similar to a target zone similar to a heavy oil zone B (362) described above in FIG. 3 and the accompanying description.

In Block 410, stimulation data are determined regarding a well stimulation operation for a geological region of interest based on well data in accordance with one or more embodiments. In some embodiments, stimulation data may describe a well stimulation operation at an injection well or a production well for a geological region of interest. For example, stimulation may specify stimulation parameters for different types of well stimulation operations, such cyclic steam stimulation (CSS), steam drive or steam flooding, and/or steam-assisted gravity drainage (SAGD). Stimulation data may include specific time periods for stimulating well, location of steam operations (e.g., location of different steam generating apparatuses in one or more wellbores), amount of steam to be produced in a particular steam operation, etc. While stimulation data may include data regarding steam operations associated with steam operations associated with steam generating apparatuses, stimulation data may also include data for other types of reservoir enhancements that may or may not be based on steam.

In Block 420, one or more steam operations are determined for a well stimulation operation based on stimulation data in accordance with one or more embodiments. For example, a steam operation may be tailored for implementing a well stimulation operation at one or more wells. In some embodiments, well stimulation control system may determine one or more parameters for performing a steam operation using one or more steam generating apparatuses.

In Block 430, a steam generating apparatus is disposed in a wellbore based on one or more steam operations in accordance with one or more embodiments. More specifically, a steam generating apparatus may be lowered into a wellbore at one or more predetermined locations based on the operational parameters of a well stimulation operation.

In Block 440, one or more laser signals are transmitted to a steam generating apparatus based on one or more steam operations in accordance with one or more embodiments. Once a steam generating apparatus is located at a predetermined location for a well stimulation operation, one or more steam operations may be performed using laser signals transmitted to a steam generating apparatus by one or more laser sources.

In some embodiments, a well stimulation control system obtains sensor data from a steam generating apparatus in response to transmitting the laser signals. Accordingly, the well stimulation control system may monitor the steam generating apparatus to determine whether the desired amount of steam has been generated in the wellbore. For example, temperature sensor data or pressure data may be used to determine when steam generation begins in order to determine completion of the steam operation. Likewise, sensor data from the steam generating apparatus may also be used to manage laser signal transmission (e.g., prevent any component on the steam generating apparatus from overheating) as well as the water supply (e.g., a container may be filling with water faster than steam may be generated).

In Block 450, various hydrocarbons are produced from a geological region of interest in response to performing one or more steam operations in accordance with one or more embodiments. After the geological region of interest is stimulated, hydrocarbon production may be obtained in a similar as described above in FIG. 1 and the accompanying description. While some embodiments are used to increase production of heavy oil, other embodiments are contemplated that include cleaning up organic deposits as well as removing condensate banking.

Figure 5:
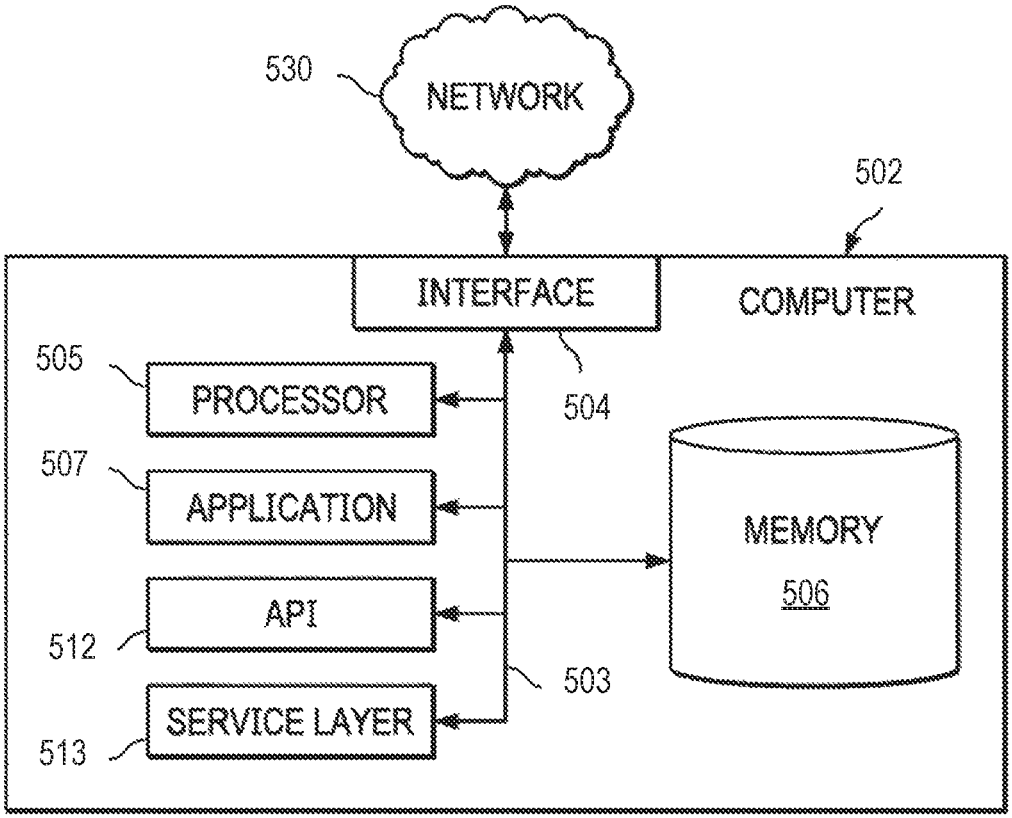
FIG. 5 shows a computer system in accordance with one or more embodiments.

Embodiments may be implemented on a computer system. FIG. 5 is a block diagram of a computer system (502) used to provide computational functionalities associated with described algorithms, methods, functions, processes, flows, and procedures as described in the instant disclosure, according to an implementation. The illustrated computer (502) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (502) may include a computer that includes an input device, such as a keypad, keyboard, touch screen, or other device that can accept user information, and an output device that conveys information associated with the operation of the computer (502), including digital data, visual, or audio information (or a combination of information), or a GUI.

The computer (502) can serve in a role as a client, network component, a server, a database or other persistency, or any other component (or a combination of roles) of a computer system for performing the subject matter described in the instant disclosure. The illustrated computer (502) is communicably coupled with a network (530). In some implementations, one or more components of the computer (502) may be configured to operate within environments, including cloud-computing-based, local, global, or other environment (or a combination of environments).

At a high level, the computer (502) is an electronic computing device operable to receive, transmit, process, store, or manage data and information associated with the described subject matter. According to some implementations, the computer (502) may also include or be communicably coupled with an application server, e-mail server, web server, caching server, streaming data server, business intelligence (BI) server, or other server (or a combination of servers).

The computer (502) can receive requests over network (530) from a client application (for example, executing on another computer (502)) and responding to the received requests by processing the said requests in an appropriate software application. In addition, requests may also be sent to the computer (502) from internal users (for example, from a command console or by other appropriate access method), external or third-parties, other automated applications, as well as any other appropriate entities, individuals, systems, or computers.

Each of the components of the computer (502) can communicate using a system bus (503). In some implementations, any or all of the components of the computer (502), both hardware or software (or a combination of hardware and software), may interface with each other or the interface (504) (or a combination of both) over the system bus (503) using an application programming interface (API) (512) or a service layer (513) (or a combination of the API (512) and service layer (513). The API (512) may include specifications for routines, data structures, and object classes. The API (512) may be either computer-language independent or dependent and refer to a complete interface, a single function, or even a set of APIs. The service layer (513) provides software services to the computer (502) or other components (whether or not illustrated) that are communicably coupled to the computer (502). The functionality of the computer (502) may be accessible for all service consumers using this service layer. Software services, such as those provided by the service layer (513), provide reusable, defined business functionalities through a defined interface. For example, the interface may be software written in JAVA, C++, or other suitable language providing data in extensible markup language (XML) format or other suitable format. While illustrated as an integrated component of the computer (502), alternative implementations may illustrate the API (512) or the service layer (513) as stand-alone components in relation to other components of the computer (502) or other components (whether or not illustrated) that are communicably coupled to the computer (502). Moreover, any or all parts of the API (512) or the service layer (513) may be implemented as child or sub-modules of another software module, enterprise application, or hardware module without departing from the scope of this disclosure.

The computer (502) includes an interface (504). Although illustrated as a single interface (504) in FIG. 5, two or more interfaces (504) may be used according to particular needs, desires, or particular implementations of the computer (502). The interface (504) is used by the computer (502) for communicating with other systems in a distributed environment that are connected to the network (530). Generally, the interface (504 includes logic encoded in software or hardware (or a combination of software and hardware) and operable to communicate with the network (530). More specifically, the interface (504) may include software supporting one or more communication protocols associated with communications such that the network (530) or interface's hardware is operable to communicate physical signals within and outside of the illustrated computer (502).

The computer (502) includes at least one computer processor (505). Although illustrated as a single computer processor (505) in FIG. 5, two or more processors may be used according to particular needs, desires, or particular implementations of the computer (502). Generally, the computer processor (505) executes instructions and manipulates data to perform the operations of the computer (502) and any algorithms, methods, functions, processes, flows, and procedures as described in the instant disclosure.

The computer (502) also includes a memory (506) that holds data for the computer (502) or other components (or a combination of both) that can be connected to the network (530). For example, memory (506) can be a database storing data consistent with this disclosure. Although illustrated as a single memory (506) in FIG. 5, two or more memories may be used according to particular needs, desires, or particular implementations of the computer (502) and the described functionality. While memory (506) is illustrated as an integral component of the computer (502), in alternative implementations, memory (506) can be external to the computer (502).

The application (507) is an algorithmic software engine providing functionality according to particular needs, desires, or particular implementations of the computer (502), particularly with respect to functionality described in this disclosure. For example, application (507) can serve as one or more components, modules, applications, etc. Further, although illustrated as a single application (507), the application (507) may be implemented as multiple applications (507) on the computer (502). In addition, although illustrated as integral to the computer (502), in alternative implementations, the application (507) can be external to the computer (502).

There may be any number of computers (502) associated with, or external to, a computer system containing computer (502), each computer (502) communicating over network (530). Further, the term "client," "user," and other appropriate terminology may be used interchangeably as appropriate without departing from the scope of this disclosure. Moreover, this disclosure contemplates that many users may use one computer (502), or that one user may use multiple computers (502).

In some embodiments, the computer (502) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, a cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed:

1. A system, comprising:

a laser source; and a steam generating apparatus coupled to the laser source and disposed in a wellbore, wherein the steam generating apparatus comprises:

a container, and a plurality of check valves, wherein the steam generating apparatus is configured to convert water inside the container into steam using a laser signal transmitted to the container from the laser source, and wherein the steam is released into the wellbore using the plurality of check valves.

2. The system of claim 1, further comprising:

an optical fiber cable, wherein the steam generating apparatus comprises a laser head, and wherein the optical fiber cable couples the laser source to the laser head.

3. The system of claim 1, further comprising:

a water source coupled to an inlet of the steam generating apparatus, wherein the water source transmits water from a surface to the container in the steam generating apparatus.

4. The system of claim 1, further comprising:

a cable conveyance system, wherein the steam generating apparatus comprises a cable head coupled to the cable conveyance system using a cable, and wherein the steam generating apparatus is configured to move to a predetermined location in the wellbore using the cable and the cable conveyance system.

5. The system of claim 1, wherein the steam generating apparatus comprises a temperature sensor coupled to the container, and wherein the temperature sensor is configured to determine a temperature of the water.

6. The system of claim 5, wherein the steam generating apparatus comprises a processor and a communication interface coupled to the processor, and wherein the communication interface is configured to transmit sensor data regarding the temperature of the water to a control system.

7. The system of claim 1, further comprising:

a control system coupled to the laser source and the steam generating apparatus, wherein the control system is configured to perform a well stimulation operation, and wherein the well stimulation operation comprises heating oil in a reservoir zone to a predetermined viscosity using the steam.

8. The system of claim 7, wherein the well stimulation operation is a cyclic steam stimulation (CSS) operation.

9. The system of claim 7, wherein the well stimulation operation is a steam flooding operation.

10. The system of claim 1, wherein the container is a spherical steel chamber.

* * * * *